United States Patent [19]

Mitchell

[11] Patent Number: 4,809,527

[45] Date of Patent: Mar. 7, 1989

[54] SHAPEMETERING APPARATUS FOR CONTINUOUS MONITORING AND/OR CORRECTION OF THE PROFILE AND FLATNESS OF ROLLED METAL STRIP AND THE LIKE

[76] Inventor: Randolph N. Mitchell, Via Vincenzo Renieri, 14, 00142 Rome, Italy

[21] Appl. No.: 886,631

[22] Filed: Jul. 16, 1986

[30] Foreign Application Priority Data

Sep. 20, 1985 [IT] Italy ..... 48579 A/85

[51] Int. Cl.[4] ..... B21B 37/06; B21B 27/10; G01B 13/22; G01L 5/08

[52] U.S. Cl. ..... 72/8; 72/12; 72/17; 72/202; 72/243; 73/37.7; 73/159

[58] Field of Search ..... 72/245, 243, 8–12, 72/16, 17, 201, 202; 73/862.07, 159, 37.7

[56] References Cited

U.S. PATENT DOCUMENTS

| | | | |
|---|---|---|---|
| 3,334,508 | 8/1967 | Martin | 73/867.07 |
| 3,485,095 | 12/1969 | Hirata et al. | 73/37.7 |
| 3,496,744 | 2/1970 | Mizuno et al. | 72/12 |
| 3,812,701 | 5/1974 | Miyamatsu et al. | 72/245 X |
| 3,868,851 | 3/1975 | Breyer | 73/37.7 X |
| 4,031,741 | 6/1977 | Schaming | 73/37.7 |
| 4,149,395 | 4/1979 | Fapiano | 72/11 |
| 4,392,367 | 7/1983 | Bald | 72/17 X |
| 4,611,479 | 9/1986 | Guttinger | 72/16 |

*Primary Examiner*—Robert L. Spruill
*Assistant Examiner*—Steven B. Katz
*Attorney, Agent, or Firm*—Laff, Whitesel, Conte & Saret

[57] ABSTRACT

A shape metering process and related apparatus for continuously detecting and measuring the profile and flatness of a rolled metal strip or a non-metallic strip coming off mill rolls, and for making continuous corrections, in real time, of the errors from which faults and unevenness in the strip tend to originate. A single source of fluid power registers differences in pressure which are localized in relative zones which are ranged transversely to the path of the strip movement and across its width. Such differences in pressure are proportional to the differences in tension with which the strip is invested. These differences can be detected, measured and displayed so as to analogically represent the shape of the strip. The same pressure can also be a continuous and direct-acting control medium for an actuation of a conventional media utilized in correcting the thermal condition of the mill rolls.

15 Claims, 5 Drawing Sheets

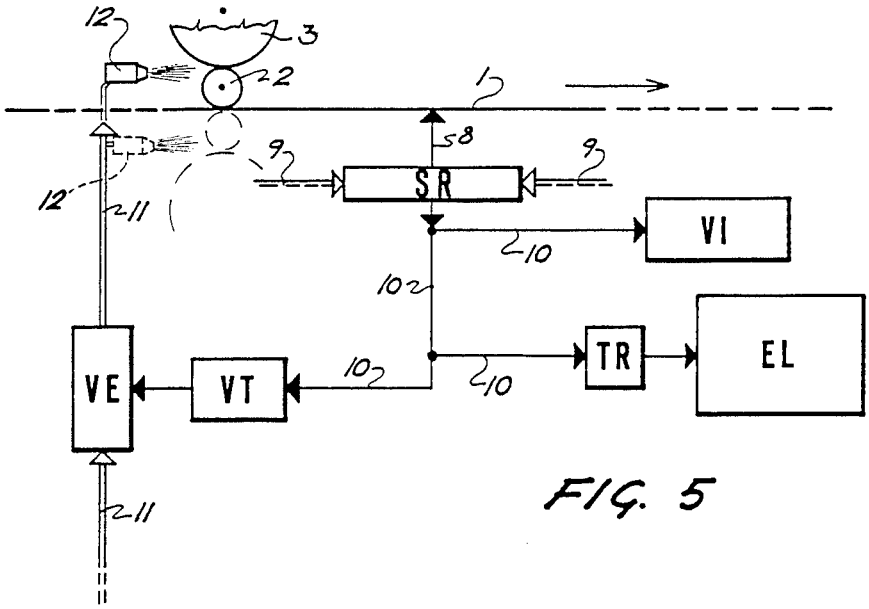
FIG. 5
FIG. 10
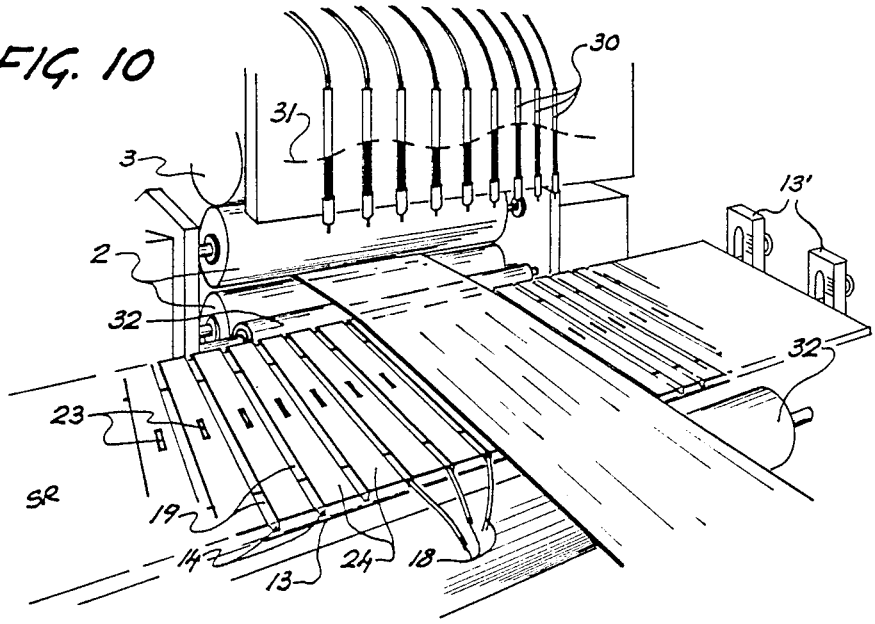

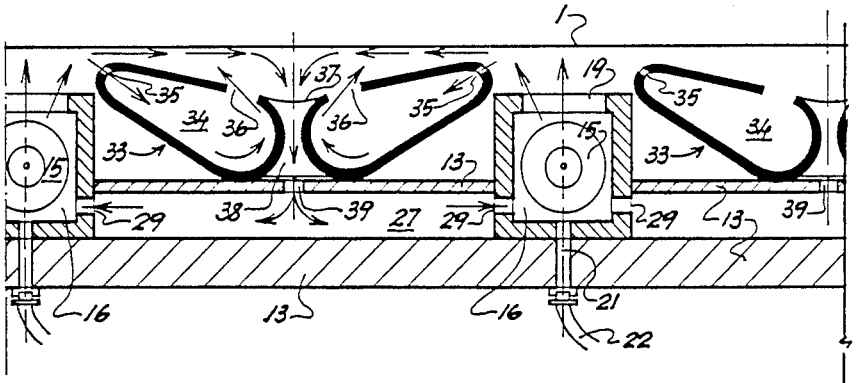
FIG 9
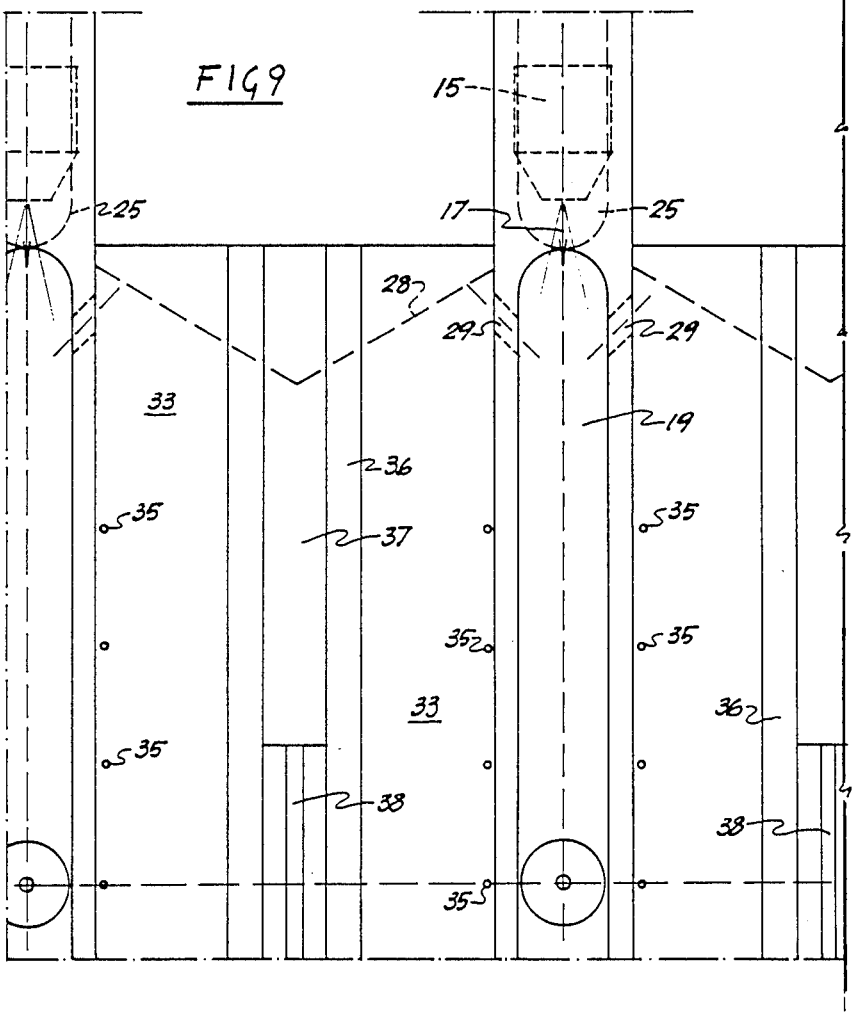

SHAPEMETERING APPARATUS FOR CONTINUOUS MONITORING AND/OR CORRECTION OF THE PROFILE AND FLATNESS OF ROLLED METAL STRIP AND THE LIKE

BACKGROUND OF THE INVENTION

The invention relates to shapemetering. A process and apparatus are disclosed for visual automatic monitoring and continuous resultant correction of the profile and surface flatness of rolled strip, metal or otherwise, and in particular for metals which are rolled and subsequently rewound.

Whilst the disclosure is directed principally toward mills utilized for rolling metal strip, the application clearly embraces other types of plant for the forming of non-metallic strip materials; thus, notwithstanding reference is made to rolled metal strip throughout the specification for ease of description, such reference in no sense limits the scope of the invention.

Detection of the shape of metal strip, that is, of its profile and flatness, is of vital importance in rolling especially since the high production tempos now reached with modern methods dictate that such an operation can no longer be committed to inspection and manual adjustment on the part of mill operators.

In FIG. 1, the schematic representation of a rolling mill, given as an example, illustrates a metal strip 1, a pair of work rolls 2 and a relative pair of back-up rolls 3. The rolled strip is rewound onto a recoiler 4.

The train of rolls, so-called, may also incorporate idle and tensioning rolls such as those denoted 32 in FIG. 1 over which the strip 1 is run in order to ensure the best possible distribution of tension and constant alignment on arrival at the recoiler 4.

During rolling, the surface of the strip 1 may appear perfectly flat and free from faults or unevenness, to the naked eye; this notwithstanding, the tension to which the strip is subject, and its high speed through the mill rolls (often hundreds of meters per minute), are such that visual inspection alone cannot detect these defects, especially where small and/or localized.

Single faults and general unevenness may be manifested in different ways, continuously or localized, occurring across the main body of the strip or near the edges alone, and may be of diverse origin. Such defects in rolled metal strip 1 can be attributable to errors in 'tilt' and 'crown' of the mill rolls 2 and 3, or more often, to the lack of proper distribution of cooling on these rolls (usually effected by spraying with special coolants). Diverse tilt and bending components can result in localized hot-spots in the surface of the strip 1 by reason of differential roll expansion, and differences in gauge across the width of the strip cause greater heating where reduction is greatest.

The need therefore exists for selective cooling along the longitudinal dimension of the rolls 2 and 3 that will take account of such deviations and diminish the effects produced thereby, thereby improving the shape of the strip as manifested on exit from the mill rolls.

The faults and unevenness in question are manifested, in practice, by surface drift which produces localized or continuous variation in the running tension of the rolled strip, hence in mechanical pressure which the strip will exert on a surface disposed beneath and transversely tangential thereto. These parameters are duly exploited in the prior art shapemetering devices currently in use, which are installed between the train of mill rolls 2 and 3 and the recoiler 4. Such prior art devices are designed, in essence, to detect a given number of increments in the width of the strip for any variation in pressure exerted by the metal in each such increment, by way of sensing elements that make contact with the running surface of the strip.

In one embodiment of such a prior art device, a number of rotors mounted adjacent to one another and rotatable on a stationary transverse shaft have respective cylindrical cavities filled with fluid which is pressurized to a constant value. Measurement of the variations in strip tension is achieved by detecting the difference in pressure of the fluid, occasioned by positive or negative shift in the strip tension transmitted to each rotor, between two opposite set points. Transducers are used to relay the detected information to a CPU which, having acknowledged and processed the input data in the prescribed manner, relays control signals which actuate appropriate corrective media.

Notwithstanding such a method is tolerably effective, the rotor device involves notably complex construction, by reason of its comprising fixed and moving parts and pressurized-fluid seals, and of its being characterized by tight tolerance margins in embodiment; the device is thus invested with a certain structural inertia which in turn has a limiting influence on sensitivity, and which, given the complexity of the control system, does not permit of real time corrective action via the media utilized for rectifying error. These design drawbacks are compounded further by a requirement for continual servicing and verification of the device's efficient operation, and by a marked energy consumption, which in turn signifies somewhat high outlay and running costs.

SUMMARY OF THE INVENTION

A fundamental object of the invention disclosed is the design and embodiment of a new shapemetering process, that is, a process for detection and measurement of faults and unevenness in the shape of rolled strip, wherein the sole medium used both in the detection and measurement of such faults and in controlling the media which provide the corrective action, is a pressurized fluid, compressed air in particular, maintained at a constant input pressure and circulated between the running metal strip and the essentially fixed and flat reacting surface of the shapemeter across a succession of width increments in the strip.

It is also an object of the invention to disclose a process wherein differences in tension in rolled strip of whatever gauge, running at whatever speed, will bring about variation in pressure of the air circulating beneath one or more of the succession of increments of an entity which is proportional to such differences in tension of the strip.

It is a further object of the invention to exploit such variation in pressure across the succession of width increments, so as to display differences in tension of the rolled strip, and obtain simultaneous actuation by proportional control of the media utilized in correcting mechanical and/or thermal mill roll variations.

The principal object of the disclosure is embodiment of apparatus to carry the claimed shapemetering process into effect, which neither has parts in contact with the running surface of the rolled strip, nor has driven moving parts, and is thus devoid of mechanical inertia and of kinematic linkages which pick up effects induced by the running metal strip via direct contact.

It is likewise an object of the disclosure to embody apparatus wherein control signals proportional to the differences in strip tension are relayed continuously to the media utilized for correcting the error from which such differences in tension originate.

Another object of the invention is that of providing a shapemetering process and embodying relative apparatus for detection, measurement and display of faults and unevenness in rolled strip, and for control of the media utilized in correcting mill roll contour, in which a single source of energy is utilized for both metering and auxiliary purposes, namely, compressed air supplied at a constant preset pressure.

Not least among the objects of the disclosure is the design and embodiment of a shapemetering process and relative apparatus featuring maximum and constant long-term efficiency, marked simplicity in construction, freedom from routine servicing, and minimal outlay and running costs.

The objects mentioned, together with others, are all realized with the shapemetering process as disclosed herein and as claimed hereinafter.

BRIEF DESCRIPTION OF THE DRAWINGS

The invention will now be described by way of example with the aid of the accompanying drawings, in which:

FIG. 5 is a block diagram illustrating the process and relative apparatus according to the invention;

FIG. 9 shows a transverse cutaway and a plan of the box structure in a further embodiment of apparatus according to the invention;

FIG. 10 is a view in perspective of apparatus according to the invention, applied to a train of rolls.

DESCRIPTION OF THE PREFERRED EMBODIMENT

Figure 2:
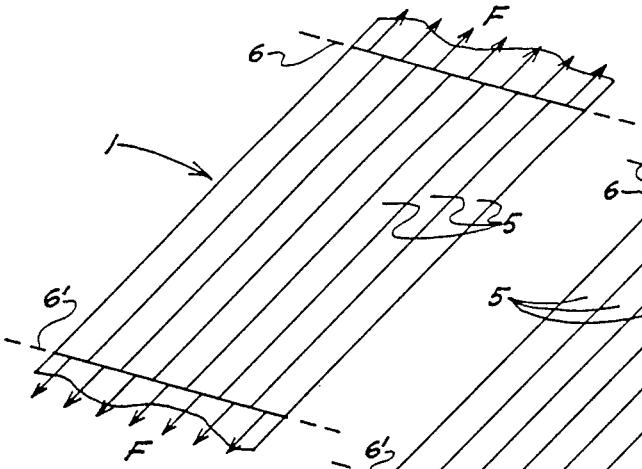
FIG. 2 is a schematic representation of the tension components (strings) in a perfectly flat stretch of rolled metal strip.
Figure 3:
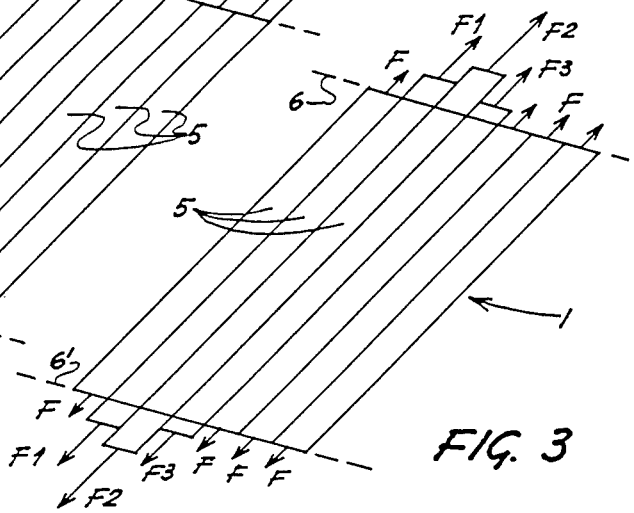
FIG. 3 is a schematic representation of the tension components in a stretch of rolled metal strip, in practice.

The objects stated at the outset are the upshot of having observed that a stretch of rolled metal sheet 1 running out from the mill rolls 2 may be thought of in theory, and represented schematically, as a number of parallel strings suspended between two straight-line supports 6 and 6', as shown in FIG. 2, all invested with equal tension F working in opposite directions. Such a representation reflects a perfectly flat stretch of metal strip 1, the imaginary strings being of equal length, and parallel one with another. By contrast, the metal strip will be invested, in practice, with varying tension components (e.g. $F_1$, $F_2$, and $F_3$) differing from string to string, which in isolation would tend to exhibit differences in length one from another (FIG. 3); such a condition is indicative of lack of flatness in the same stretch of strip.

Figure 4:
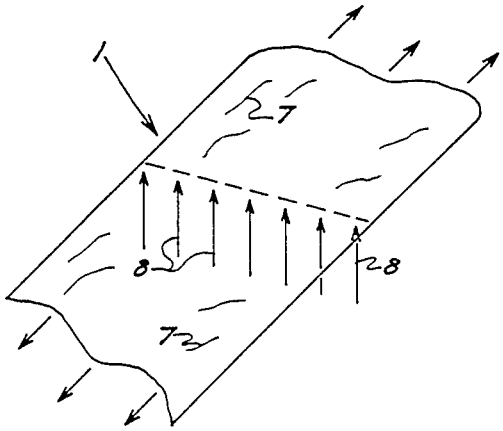
FIG. 4 is the schematic representation of a stretch of rolled metal strip undergoing the process according to the invention.

Considering the effective limitations represented by the straight-line supports 6 and 6', the greater or the lesser tension with which certain of the strings are invested, and the greater or the lesser length induced, give rise to faults and unevenness in the strip which are manifested in zones 7 exhibiting a departure from perfect flatness (as in FIG. 4).

If, as the invention envisages, one applies a series of forces 8 perpendicular to the strip, parallel with one another and ranged uniformly along a line transverse to its path of movement, so as to suspend the strip itself (FIG. 4), then forces of lesser entity will be produced at the zones of major departure from perfect flatness, and forces of greater entity at the zones of minor departure, that is, zones in which the strip is better-tensioned and the imaginary strings therefore approach flatness. Taking as par the maximum force required to suspend the strip in conditions of perfect flatness, one will have progressively diminishing forces at zones with progressively increasing departure from such flatness; by measuring such a diminishment in applied force one obtains a value which is proportional to loss of shape in the strip, or in other words, to the difference in tension of the imaginary string.

The process disclosed herein, to the end of realizing the proposed objects, is illustrated schematically in FIG. 5, and envisages the application of a plurality of forces 8 perpendicular to the running strip 1, ranged across a succession of increments occupying the width of the strip and transverse to its path of movement. The single forces 8 originate from a single fluid power source 9 supplied at a constant pressure, which is compressed air in the case of the disclosure. Intensity of the single forces must be calibrated to the point of suspending the rolled metal strip, assumed perfectly flat and evenly tensioned, and referred to an adjacent surface of the apparatus SR, by selection and subsequent variation of a given pressure value at source which will depend ultimately on the type, gauge, and running speed of the rolled strip.

The next step in the process is continuous measurement of the intensity of each single force at the axis of its point of application, an entity that is dependent upon the pressure of fluid applied to the corresponding zone of the metal strip, and upon resistance offered to such pressure by the strip, i.e. back-pressure which reflects the degree of departure from perfect flatness at such a zone.

These entities of pressure and their variations 10 (denoted schematically in FIG. 5) register continuously, and are detected by a measuring instrument VI designed to provide an ordered analogical display of values corresponding to the transverse succession of increments occupying the width of the metal strip. The operator is thus able to monitor the intensity of single forces 8 in continuous fashion, being provided with an overall picture of shift induced by loss of shape in the strip, and accordingly, to implement the necessary corrective measures.

The differences in pressure detected continuously in this way for each force 8 applied are utilized as a proportional control medium for transducers, mechanical or electrical, by means of which to trigger actuation of whatever media is utilized for selective correction of thermal conditions in the mill rolls 2 and 3.

In practice, such differences in pressure are exploited to operate valve transducers VT (for instance, hydraulically operated valves) designed to pilot the proportional opening or closing movement, according to a selected scale, of conventional valves VE supplying coolant 11 to corresponding tiers of spray nozzles 12 directed at the section or sections of the mill rolls 2 and 3 which correspond to the strip width increment or increments from where the control signal or signals will have originated. The plurality of forces 8 incorporated into the system will thus be matched, both in number and for position, by corresponding groups of sprays at the mill rolls. The same differences in pressure registering at the point of application of each force 8 can be exploited further as an input for electrical or electronic transducers TR so as to provide signals relayed to means for automatic operation and control of the whole shapemeter system, which, in the case of the conventional CPU denoted EL (FIG. 5) will be allotted the task of analyzing the variations detected and supplying the appropriate control signals to actuate corrective measures, for example, changing the tilt or bending force/moment of the back-up rolls 3, modifying the running speed of the strip 1 or adjusting the pressure of compressed air and/or coolant.

Figure 1:
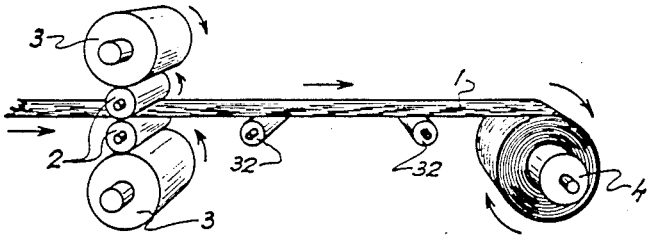
FIG. 1 is the schematic representation of a train of mill rolls.

According to the invention, the process thus described is carried into effect by apparatus which is designed for installation along the stretch of rolled strip running between the mill rolls 2 and 3 and recoiler 4, and in particular, between two idle rolls 32 the purpose of which is to maintain the running surface of the stretch in question at a constant lie, relative to the reference surface SR of the apparatus (FIGS. 1 and 10).

Referring now to FIGS. 6, 7, 8 and 9, the apparatus is comprised substantially of an essentially flat box-structure 13 extending transversely in relation to the path of movement of the strip 1, and incorporating a plurality of channels 14 disposed parallel one with another and spaced apart at a given equal distance one from the next. Conventional means 13' are provided for adjusting the position of the box-structure 13. The channels 14 lie parallel to the path of movement of the strip, considered longitudinally, (FIG. 10) and each channel is provided with a pair of nozzles 15 mounted one at either end in direct opposition so as to produce respective jets 17 of compressed air (FIG. 7) that are thus in collision within the enclosure 16 formed by the channel. The nozzles 15 can be adjusted by the adjusting screws shown. This compressed air is the sole source of fluid power for operation both of the apparatus and of its auxiliary services and is supplied to each of the channels 14 from a single source by relative pairs of air-lines 18; the same air supply thus serves to create the plurality of forces 8 aforementioned, and to provide a proportional control medium 10 (FIG. 5) as already mentioned in the foregoing description.

Figure 7:
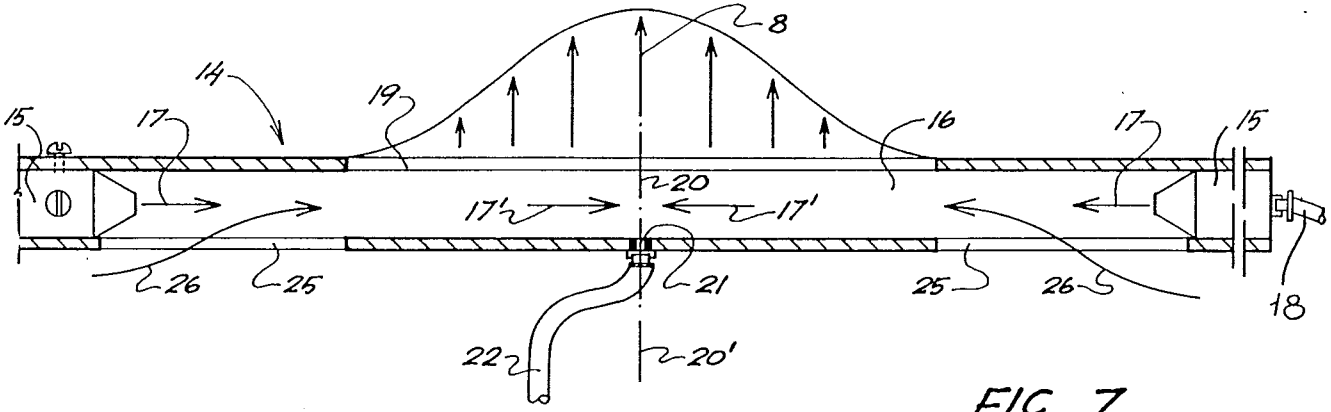
FIG. 7 is the longitudinal section through a channel of the apparatus according to the invention.

Each single channel 14, which exhibits a quadrangular section in a preferred embodiment, has a longitudinal opening 19 located in the side offered to the strip 1, that extends equal distance forward and rear from a dividing section 20 passing transversely through the channel as shown in FIG. 7. This dividing section 20 establishes an absolutely central collision zone for each pair of opposed jets 17 where a conversion is brought about, according to known physical principles, in which kinetic energy carried by the jets is transformed into pressure that is directed perpendicularly toward the strip 1 via the longitudinal opening 19, causing the strip to take on the essentially parabolic configuration in FIG. 7. Pressure thus directed at the strip reaches a maximum value when coincident with the axis 20' of the collision zone 20, and this is in fact the force 8 which is applied to the rolled strip at the central transverse axis of each opening 19.

Each channel 14 is provided further with an outlet 21, likewise coincident with the axis of the collision zone and located at the side opposite the opening 19, which connects via a relative fluid line 22 (FIGS. 6 and 7) with means for continuous detection and measurement of the force 8, i.e. of the pressure value and its variations, registering at axis 20'.

The box-structure 13 also incorporates a plurality of single vents 23 disposed parallel to and in alternation with the channels 14 and aligned with the longitudinal openings, hence with the collision zones 20, which provide an escape (denoted by arrows in FIG. 6) for the air issuing from adjacent openings 19.

Figure 6:
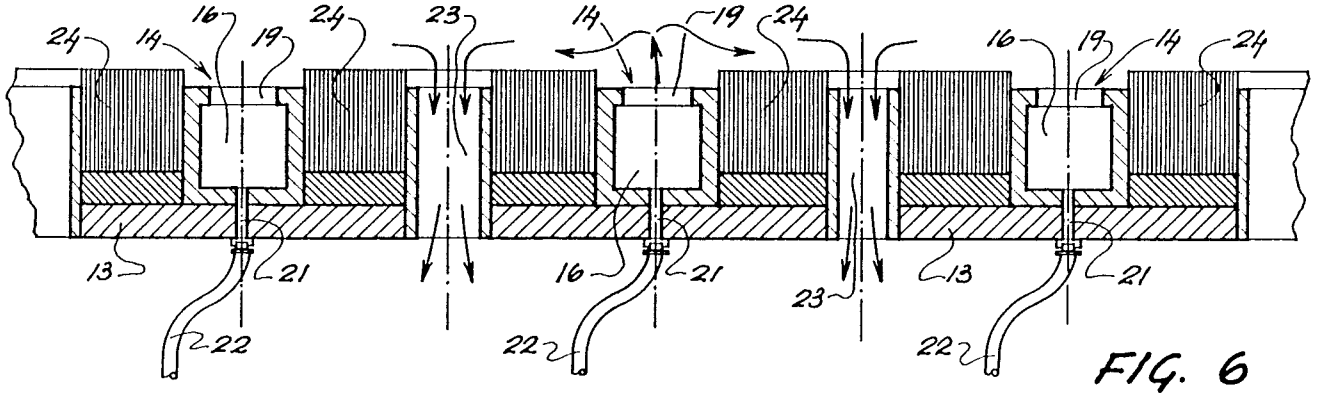
FIG. 6 is a transverse section through the box-structure of apparatus according to the invention.

In one embodiment of the invention, the box-structure 13 further comprises lengths of fibrous and/or flexible material 24, say—felt or carpet, located between adjacent channels 14, which surround the vents 23 such that the surface of the vent aligns with that of the length of material (see FIGS. 6 and 10). These lengths of material create a surface across which the strip 1 can ride without encountering any resistance other than a bare minimum, suspended as it is by thrust from the forces 8 aforedescribed, and serve to establish a permeable barrier offered to the streams of air escaping from the adjacent openings 19, which are broken up in order to prevent interference between one escaping stream and the next, across the apparatus.

Figure 8:
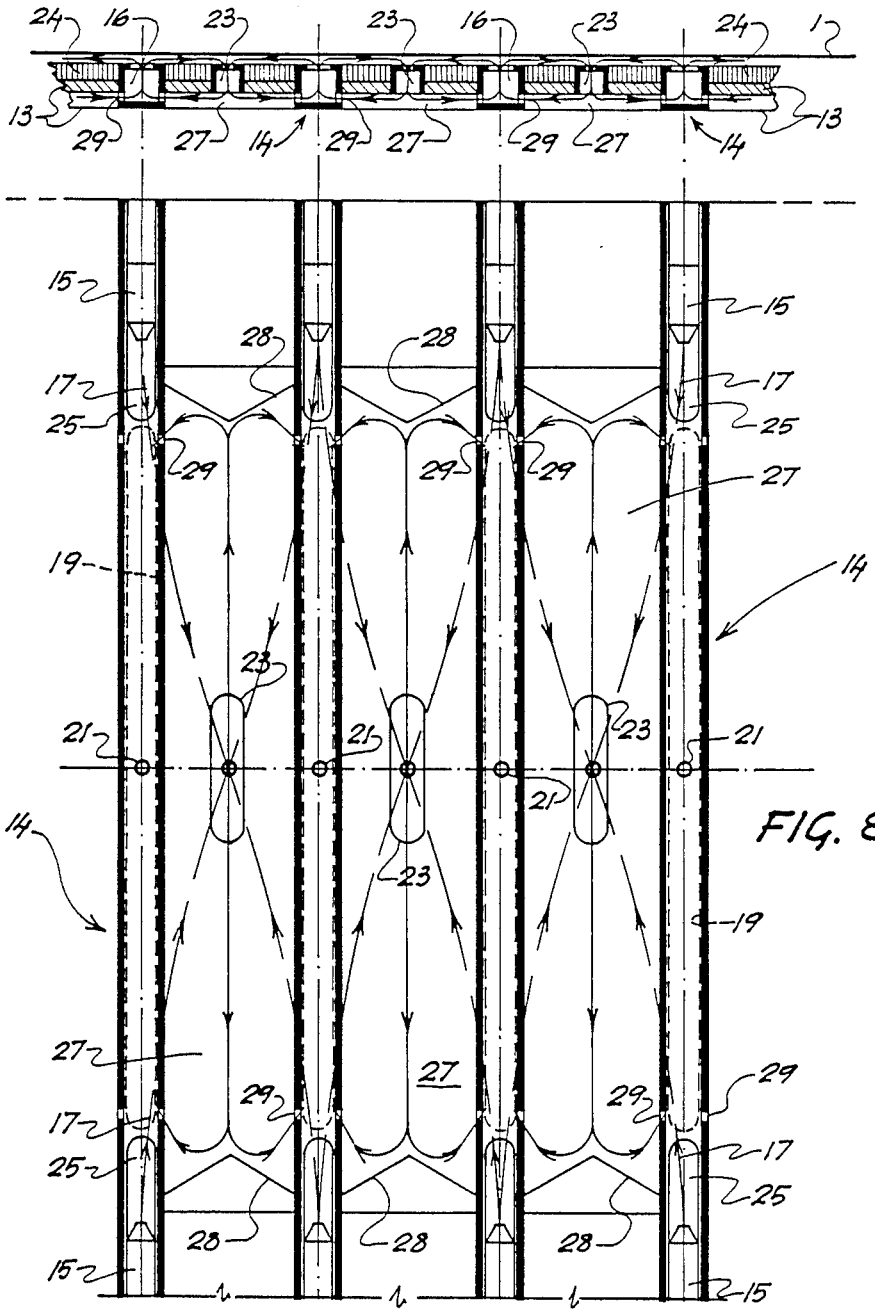
FIG. 8 shows a transverse cutaway and a plan of the box structure in apparatus according to the invention.

The transverse sections in FIGS. 6 and 8 afford a schematic representation of the circulation of air escaping from the channel openings 19; checked by the surface of the strip 1, the air-stream is drawn back through the effect of difference in pressure down the side walls of the vents 23, which communicate with the surrounding environment in a first, more simple embodiment of the apparatus. In this embodiment, each channel 14 exhibits a pair of identical inlets 25 in the side opposite that incorporating the longitudinal opening 19, located one at either end inwardly from and below the respective nozzle 15; air is drawn through these inlets 25 into the channel enclosure 16 from the surrounding environment (denoted by the arrows 26 in FIG. 7) as a result of the depression created by the jets 17. This intake of air 26 at either end joins with and integrates the two colliding jets 17, and is thus instrumental in producing jets 17' of increased volume at the collision zone 20. In this way one obtains a reduction in the volume of air required from the power source, efficiency being assumed as par, and a more balanced utilization of available energy in consequence.

In a further embodiment, the box-structure 13 is such that those sections beneath the permeable barrier material 24 and between adjacent channels 14 are boxed in to create chambers 27 in which air may circulate, as shown in FIG. 8. Such chambers 27 communicate uppermost with a respective vent 23 and are provided with air-deflection profiles 28 located one at either end; in addition, each chamber 27 communicates at either end with the two adjacent channels 14 by way of a pair of air holes 29 located in the channel side walls, each alongside a relative air-deflection profile 28. Each hole 29 is angled so as to complement the slant of the profile, and communicates with the inside of one end of a relative channel enclosure 16 at a point in sight of the inward-facing end of the nozzle.

Thus embodied, the chamber 27 provides for recirculation of air escaping from the vents 23 back into the channels at either side, as illustrated by the arrows in FIG. 8; recirculated air joins and integrates the streams 26 already taken in via the bottom inlets, increasing the ultimate volume of the colliding jets 17' and further enhancing balanced utilization of available energy by cutting the volume requirement at source.

In a further embodiment, preferred over the above, the lengths of barrier material 24 are replaced to advantage by hollow longitudinal elements 33 arranged in like manner and shaped in such a way as to create a pair of symmetrical enclosures 34 which exhibit a pear-drop profile when seen in cross section, as in FIG. 9. Each such enclosure 34 is provided with a longitudinal succession of holes 35 at the side of the profile exhibiting the tighter radius, which are directed toward the longitudinal opening 19 of the respective channel 14 alongside, and with longitudinal openings 36 at the side exhibiting wider radius, which are directed toward the surface of the strip 1.

Each pair of elements 33 creating the symmetrical pair of enclosures 34 is joined together by an interconnecting profile 37. A slot 38, located in this profile 37, performs exactly the same function as the vents 23 in the first embodiment described, communicating as it does with the chambers 27, air-deflection profiles 28 and air holes 29, by way of a corresponding slot 39 in the box-structure 13.

In this embodiment one sets up a circulation of air, escaping from the openings 19 and deflected by the surface of the strip 1, which follows the pattern of the arrows in FIG. 9 and achieves almost total isolation of the air streams escaping from adjacent longitudinal openings 19, thereby avoiding mutual disturbance and, in addition, producing an air cushion effect which will enable the strip 1 to ride forward encountering no resistance; what is more, one obtains almost total recirculation of air, and a more balanced utilization of available energy in consequence.

It is clear that the quantity of air in circulation in the apparatus must remain constant, and this is ensured by a natural escape of the air at either end of the apparatus along the direction of the running strip. In accordance with the process disclosed, intensity of the single applied forces 8 is measured by detecting pressure which registers through the axes 20' of the relative collision zones 20 and reflects back-pressure from the strip 1 utilizing manometers of a conventional type, served by fluid lines 22 which are connected to outlets 21 coincident with the single axes 20'.

The manometers are ordered in an array that mirrors the tranverse succession of width increments making up the strip and corresponds to the single channels 14, providing a display wherein variations in pressure per increment are visualized in continuous fashion; being proportionate to the degree of tension with which the strip 1 is invested, such variations reflect the extent of departure from flatness, hence the term shapemeter. In a preferred embodiment, the manometers 30 are of a type utilizing a column of liquid, and are located in vertical and parallel array across the apparatus so as to provide a permanent analogical display that monitors strip shape by way of an imaginary curve 31 coinciding with the single liquid levels (FIG. 10), and therefore reflecting the variations in tension across the strip. The fluid lines 22 to the manometers are branched as shown schematically by lines 10 in FIG. 5, and connect with respective valve transducers VT which actuate the continuous opening and closing movement of a corresponding number of supply valves VE controlling the flow of coolant 11, in proportional response to the differences in pressure registering through the self-same lines 22, and according to a predetermined scale.

The coolant valves VE are of a conventional type. The valve transducers VT may be any one of a number of types, diaphragm for example, or hydraulically operated for preference, and must convert the pressure registering through single fluid lines 22 into mechanical or electrical power such as will open or close the coolant supply valves VE in proportion to such pressure. The process and apparatus thus described are such that, in accordance with the stated objects, differences in pressure registering continuously as a result of faults or unevenness in the metal strip 1 may be exploited for continuous and proportional control of the circult that supplies coolant 11 to the groups of spray nozzles 12 at the mill rolls.

Such control is brought about in real time and with no interruption other than that produced by insignificant levels of inertia in valves VT and VE; what is more, the reading requires no intermediate measure-calculate-and-respond circuitry. Clearly, apparatus such as that described will be embodied such that the channels 14, vents 23 or slots 39, display manometers 30 and valves VT and VE correspond in number to the pairs of conventional grouped spray nozzles 12 installed along the mill rolls 2 and 3, and occupy corresponding transverse positions across the width of the strip 1.

Apparatus according to the invention thus realizes the stated objects, permitting of continuous and automatic selective correction of thermal conditions in the mill rolls 2 and 3 in real time, and continuous visualization of the flatness of the strip 1 such as will furnish the mill operator with an indication as to when corrective measures should be implemented, e.g. modification of the tilt and/or the crown of the mill rolls 2 and 3. The branched fluid lines 22 may also be connected to relative electric/electronic transducers TR (FIG. 5) in order to provide a continuous input for a CPU, denoted EL in FIG. 5, which will program and run the complete system automatically, as aforementioned.

The perspective view of FIG. 10 shows apparatus of the type described where, in the interests of simplicity, means for adjusting and positioning the box-structure are omitted, being common knowledge to one having skill in the art; the box-structure 13 must in fact be placed such that its reference surface SR lies adjacent to the running metal strip 1.

Likewise in the interests of simplicity, FIGS. 7, 8 and 9 do not show means for micrometric positioning of the nozzles 15 and for adjustment of the colliding jets 17 and 17' with respect to the collision zone 20, which are similarly commonplace to one skilled in the art.

What is claimed:

1. Apparatus for the monitoring and continuously correcting a profile and surface flatness in a metal strip for a continuous rolling mill where the strip is subsequently rewound, said apparatus comprising: a flat box-structure disposed transversely in relation to a running strip and carrying a plurality of evenly-spaced parallel channels which extend longitudinally and parallel to the direction followed by the running strip; pairs of opposed nozzles located at respective ends of each channel, supplying via corresponding lines compressed air, said air being supplied at constant pressure and from a single source, said air being jetted into the channel; a longitudinal opening in a side of each channel which opposes the strip, said opening extending an equal distance forward and rear from a dividing section that passes transversely through the channel and creates a collision zone between the opposed jets, said collision bringing about a conversion of kinetic energy in each air-stream into pressure which is applied by way of the longitudinal opening perpendicularly against the running strip, said energy reaching a maximum value when it is coincident with the axis of said collision zone; an outlet coincident with the axis of said collision zone located in a side of each channel which is opposite the opening, and which is connected by way of a fluid line to means for continuously detecting and measuring pressure and variations therein at the collision zone; single vents located in the box-structure, said vents being disposed parallel to and in alternation with the channels and being in longitudinal alignment with the channel openings and with the collision zone which provide an escape for air issuing from said openings.

2. The apparatus as in claim 1, wherein a single source of fluid at constant pressure is coupled to serve all pairs of opposed nozzles.

3. The apparatus as in claim 1, and means for making micrometric adjustments of the position of the nozzles to ensure a precise collision of the jets at the dividing section which passes transversely through the channel.

4. The apparatus as in claim 1, wherein the channels are of quadrangular section.

5. The apparatus as in claim 1 wherein each channel has a pair of identical inlets in the side opposite the longitudinal opening, said inlets being located at and inwardly from either end and below an associated nozzle through which air is drawn into the channel enclosure, said air being drawn from the surrounding environment as a result of the depression created by the jets, said drawn in air joining with and integrating into two colliding jets, thereby producing jets of increased volume at the collision zone and reducing the volume of compressed air which is required at the source.

6. The apparatus as in claim 1, wherein lengths of fibrous or flexible barrier material are located between adjacent channels and surround the vents so that the surface of a single vent aligns with the surface of the barrier material.

7. The apparatus as in claim 1, wherein the box-structure has hollow longitudinal elements arranged in pairs between one channel and the next channel to create pairs of symmetrical enclosures which exhibit a pear-drop profile when seen in cross section; each of said symmetrical enclosures having a longitudinal succession of holes at a side of the profile exhibiting a tighter radius, said holes being directed toward the longitudinal opening of the respective channel, longitudinal openings at a side of the profile exhibiting a wider radius, said longitudinal opening being directed toward the surface of the strip; each pair of elements creating the symmetrical pair of enclosures being joined together by an interconnecting profile with a slot in communication with a corresponding slot in the box-structure; and said symmetrical enclosures, holes and longitudinal openings setting up a circulation of air-streams escaping from the openings of adjacent channels which isolate said air-streams from one another, thereby avoiding mutual disturbance and producing an air cushion on which the strip rides forward with substantially little resistance.

8. The apparatus as in claim 1 wherein the sections of the box-structure which are between adjacent channels are boxed in order to create chambers in which air may circulate, said chambers communicating uppermost with a vent or with the slot of a corresponding pair of hollow elements, and chambers having air-deflection profiles located at either end, wherein each chamber communicates at either end with the two adjacent channels via a pair of air-holes located in the channel side walls alongside a deflection profile, said air holes being angled so as to complement the slant thereof, said air holes communicating with the inside of one end of a relative channel enclosure at a point which is in sight of the inwardly-facing end of the nozzle; and wherein the chamber provides a recirculation of air escaping from the vent or slot and back into the channels at either side via a deflection off the profiles and through the angled air-holes in order to join with and integrate the jets, for producing jets of increased volume at the collision zone and for enabling a reduction in the volume of compressed air required at a source.

9. The apparatus as in claim 8 wherein a fluid line is coupled to each outlet coincident with the axis of the collision zone at each channel and is connected to one of an array of manometers, means responsive to said manometers for giving a continuous analogical display of shifts from a maximum pressure set-point registering at each of the channels, said display showing the differences in pressure existing at each corresponding width increment of the strip.

10. The apparatus as in claim 9, wherein the manometers utilize a column of liquid and are located in a vertical and parallel array which corresponds to the succession of channels, said display providing a monitoring shape corresponding to an imaginary curve that coincides with the single liquid levels and reflects variations in tension across the strip.

11. The apparatus as in claim 1, wherein the fluid line is branched to connect to a respective valve transducer means which actuate the opening and closing movement of corresponding groups of supply valves in a response which is proportional to the differences in pressure which register through the same lines and reflect back-pressure from the running strip at each channel opening, said difference being detected at the collision zone; and valve means for controlling the flow of coolant to groups of spray nozzles aimed at a mill roll.

12. The apparatus as in claim 11, wherein the valve transducers are hydraulically-operated valve transducers.

13. The apparatus as in claim 11, wherein the channels, the vents, and the display manometers, valve transducer and supply valves correspond in number to the pairs of grouped coolant spray nozzles ranged across the longitudinal dimension of the mill rolls; and wherein the channels and the pairs of grouped coolant spray nozzles occupy corresponding transverse positions across the width of the strip.

14. The apparatus as in claim 1 wherein the fluid line connected to each outlet which is coincident with the axis of the collision zone at each channel is branched in order to connect with a respective electric transducer for providing an input to a control processing unit for automatic operation and control of a shape metering system.

15. The apparatus as in claim 1, wherein means are provided for adjusting a position of the box-structure which ensures that its reference surface lies adjacent to the surface of the running strip.

* * * * *